US009797249B2

(12) United States Patent
Rataj et al.

(10) Patent No.: US 9,797,249 B2
(45) Date of Patent: Oct. 24, 2017

(54) FRICTION BOLT

(71) Applicant: SANDVIK INTELECTUAL PROPERTY AB, Sandviken (SE)

(72) Inventors: Mieczyslaw Rataj, New South Wales (AU); Justyna Czekaj, Canning Vale (AU); Bradley Darlington, Canning Vale (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/317,883

(22) PCT Filed: Jun. 8, 2015

(86) PCT No.: PCT/EP2015/062702

§ 371 (c)(1),
(2) Date: Dec. 9, 2016

(87) PCT Pub. No.: WO2015/189146

PCT Pub. Date: Dec. 17, 2015

(65) Prior Publication Data

US 2017/0107815 A1 Apr. 20, 2017

(30) Foreign Application Priority Data

Jun. 13, 2014 (AU) ..... 2014902255

(51) Int. Cl.
*E21D 21/00* (2006.01)

(52) U.S. Cl.
CPC ..... *E21D 21/004* (2013.01); *E21D 21/0033* (2013.01)

(58) Field of Classification Search
CPC ..... E21D 21/0026; E21D 21/004; E21D 21/0033; E21D 21/0066
See application file for complete search history.

(56) References Cited

U.S. PATENT DOCUMENTS 4,112,813 A 9/1978 Kuhlmann et al.
2007/0196183 A1* 8/2007 Valgora ..... E21D 21/004 405/259.3

(Continued)

FOREIGN PATENT DOCUMENTS

WO 2010104460 A1 9/2010

*Primary Examiner* — Benjamin Fiorello
(74) *Attorney, Agent, or Firm* — Corinne R. Gorski

(57) ABSTRACT

A friction bolt for frictionally engaging the internal surface of a bore includes a circular tube, which is split longitudinally, and which has a leading end and trailing end. An expander mechanism is disposed within the tube towards the leading end. An elongate bar/cable is disposed within the tube and extends between the expander mechanism at one end and an anchor arrangement at the other end. The bar/cable extends through a ring attached to the trailing end into connection with the anchor arrangement. A restrainer member is disposed within the tube adjacent the ring and extends at least partially about and in engagement with the bar/cable. The tube has a weakened region adjacent the ring and the restrainer member extends longitudinally within the tube past the weakened region. The restrainer member includes a projection that projects through the longitudinal split of the tube for engagement with the bore.

24 Claims, 4 Drawing Sheets

(56) References Cited

U.S. PATENT DOCUMENTS

| | | | | |
|---|---|---|---|---|
| 2007/0269274 | A1* | 11/2007 | Seedsman | E21D 21/0033 405/259.1 |
| 2010/0003088 | A1* | 1/2010 | Grocholewski | E02D 5/808 405/259.5 |
| 2012/0163924 | A1* | 6/2012 | Rataj | E21D 21/0033 405/259.3 |
| 2014/0099167 | A1* | 4/2014 | Zeitler | E21D 21/008 405/259.1 |

* cited by examiner

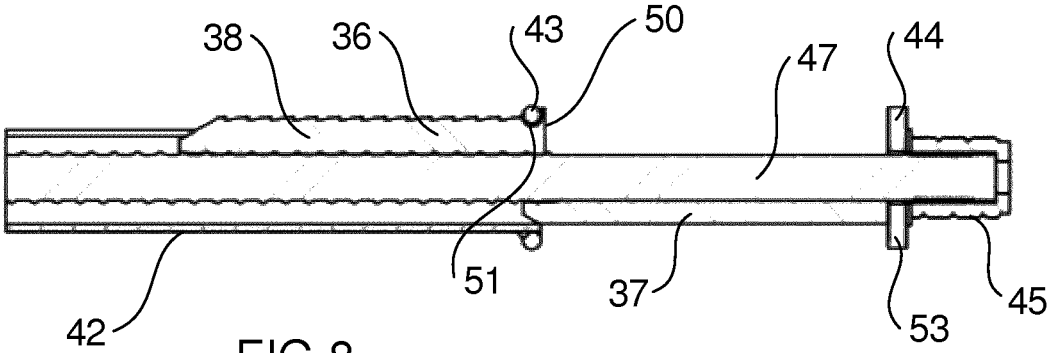
FIG 8
FIG 9
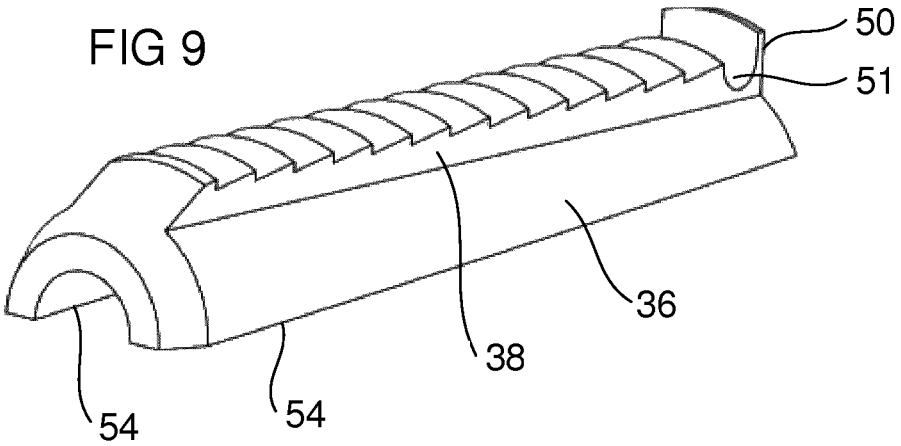
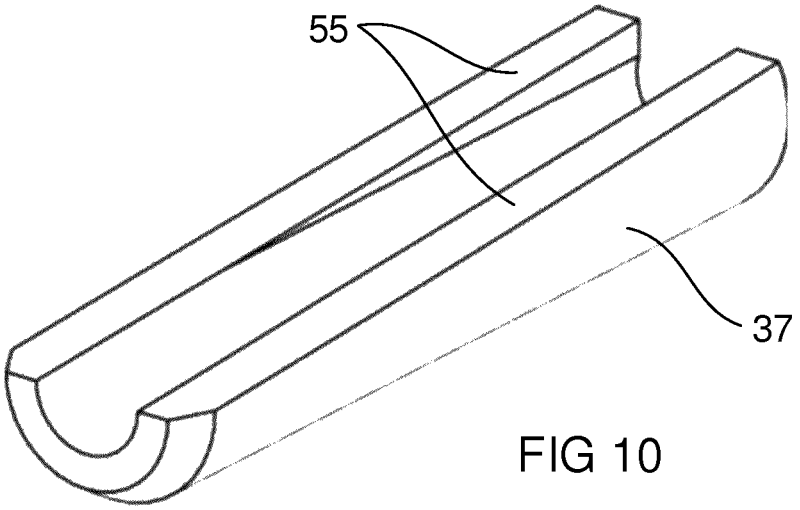
FIG 10

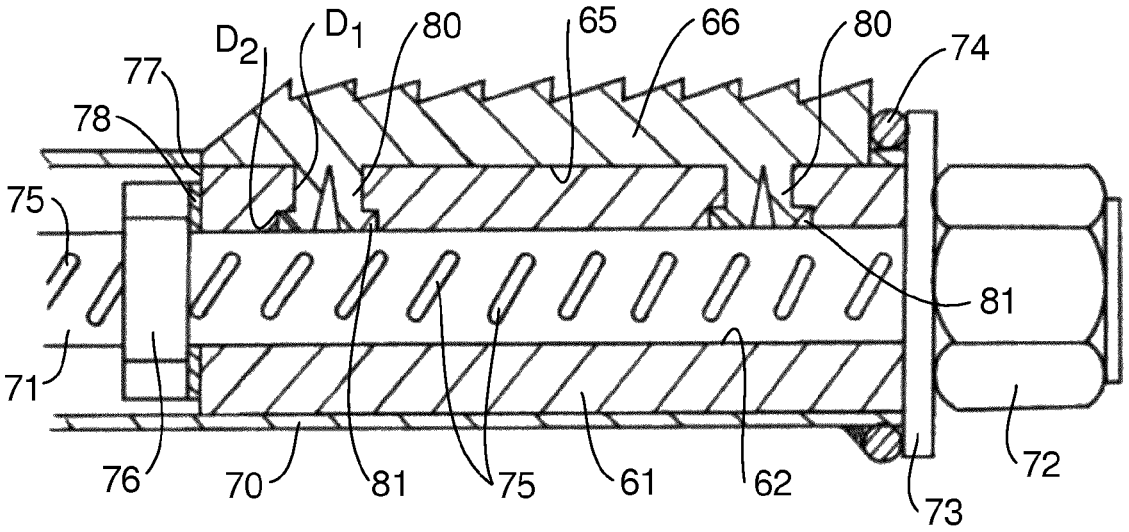
FIG 12
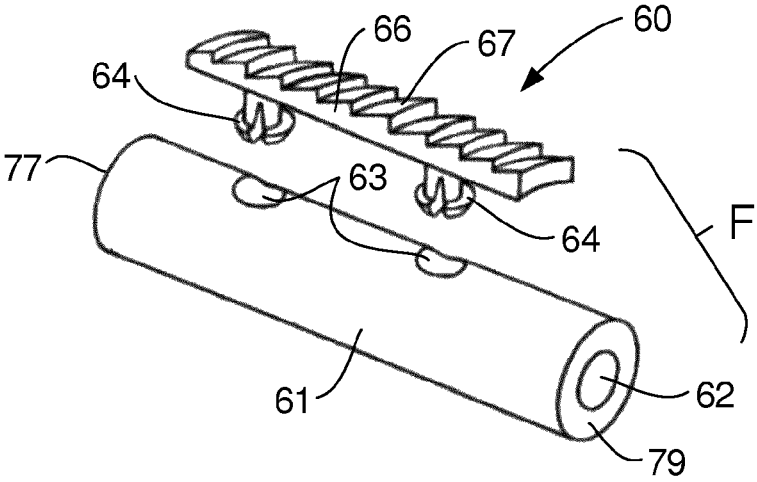
FIG 11
FIG 13
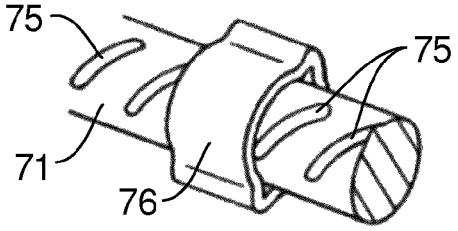

FRICTION BOLT

RELATED APPLICATION DATA

This application is a §371 National Stage Application of PCT International Application No. PCT/EP2015/062702 filed Jun. 8, 2015 claiming priority of AU Application No. 201490225, filed Jun. 13, 2014.

TECHNICAL FIELD

The present invention relates to a rock bolt for use in rock strata for the purpose of stabilising the strata against fracture or collapse. Such rock bolts are used extensively in the mining, tunnelling and excavation industries. The present invention is concerned principally with friction rock bolts and a basic form of this kind of rock bolt consists of a longitudinally split steel tube that is forced into a bore drilled into rock strata, so that the external surface of the tube frictionally engages the internal surface of the bore. Thus, the tube is frictionally anchored within the bore and by that anchoring, the rock strata is stabilised.

The present invention relates to a particular form of the above kind of rock bolt which is radially expandable by an internal expansion mechanism to promote radial expansion and thus to enhance the frictional engagement of the bolt with the internal surface of the bore. This form of rock bolt is known as an expansion rock bolt.

BACKGROUND OF INVENTION

Expansion rock bolts are installed by drilling a bore into the rock strata, inserting the rock bolt into the bore and expanding the expansion mechanism within the tube of the bolt. Expansion rock bolts include an elongate tube, which is usually split longitudinally, with an expander mechanism positioned within the tube, normally towards the leading end of the tube that is inserted first into the drilled bore in the rock strata or wall. The expander mechanism is connected to a flexible cable or solid bar that extends to the trailing end of the rock bolt and attaches to an anchor. Expansion of the expansion mechanism is effected by pulling or rotating the cable or bar.

The bore that is drilled into the rock strata is intended to be of a smaller diameter than the outside diameter of the tube, so that the tube is already a friction fit within the bore prior to expansion of the expansion mechanism. This maximises frictional engagement of the rock bolt with the bore wall. This method of insertion is relatively simple and is in contrast with other forms of rock bolts that employ resin or grout to anchor the rock bolt within the bore.

The simplicity of installation of expansion rock bolts is in contrast with installation of resin anchored bolts, in which a resin cartridge is usually employed. The resin cartridge is required to be inserted into the bore prior to the bolt being inserted therein. Insertion of the resin cartridge is sometimes very difficult, because typically the tunnel walls extend to a significant height, so that access to bores into which the cartridge is to be inserted can be inconvenient. Additionally, the resin which is employed is relatively expensive and has a limited shelf life.

Cement grouted rock bolts are less expensive than resin anchored bolts, but application of the cement is more cumbersome than that of the resin. Cement grouting requires cement mixing equipment, as well as pumping and delivery equipment, to deliver the mixed cement into the bore.

Resin or cement anchored rock bolts generally anchor in a bore to provide greater levels of rock reinforcement or stabilisation as compared to friction rock bolts, because such bolts usually have a better bond between the bore wall and the resin or cement, compared to the frictional engagement of a friction rock bolt. Also, particularly for cement anchored rock bolts, there is a proper bond along the full length of the rock bolt and the bore wall. However, the advantages of speed of installation and cost make friction rock bolts attractive in suitable environments.

Any form of rock bolt is liable to fail if the bolt is exposed to excessive loading by the rock strata into which the bolt has been installed. Failure can be tensile or shear failure or it can be a combination of tensile and shear failure. In expansion rock bolts, the bolt can fail through fracture of the tube. Failure of that kind can often be tolerated provided the bar or cable of the bolt does not fail also. However, if the rock bolt is loaded to the extent that both the tube and the bar or cable both fail, then there is the potential that a section of the rock bolt that is towards the open end of the bore (the trailing end of the rock bolt) can eject from the bore with considerable momentum, posing a danger to workers and equipment within the immediate vicinity. The section of the rock bolt that can eject from the bore can include a portion of the tube and the bar or cable, the anchor mechanism that attaches to the trailing end of the cable or bar, and the rock plate. Sometimes other accessories can also be included in the ejected section.

It will thus be readily apparent that prevention of an ejection of the above kind would be desirable.

SUMMARY OF INVENTION

According to the present invention there is provided a friction bolt, for frictionally engaging the internal surface of a bore drilled into a rock strata, the friction bolt comprising; 1) an elongate, generally circular tube which is split longitudinally for radial expansion, the tube having a leading end and a trailing end, and an expander mechanism disposed within the tube in the region of the leading end, for applying a load tending to expand at least a section of the tube radially, 2) an elongate bar or cable disposed longitudinally within the tube and in connection at or towards a first end of the bar or cable with the expander mechanism and in connection at or towards a second and opposite end of the bar with an anchor arrangement positioned at the trailing end of the tube, 3) a ring welded to the trailing end of the tube and the bar or cable extending through the ring beyond the trailing end of the tube into connection with the anchor arrangement, a restrainer member being disposed within the tube adjacent the ring, the restrainer member extending at least partly about the bar or cable and being in engagement with the bar or cable, 4) the tube having a weakened region adjacent the ring and the restrainer member extending longitudinally within the tube past the weakened region in the direction of the leading end of the tube, 5) the restrainer member including a projection that projects through the longitudinal split of the tube for engagement with the facing wall of a bore that the rock bolt is inserted into.

A friction bolt according to the invention advantageously can prevent the ejection under load of the portion of the bar or cable of the rock bolt that could otherwise be ejected out of the bore in absence of the restrainer member, as well as the components and accessories attached to that portion of the bar or cable, thereby improving the safety for workers and equipment in the vicinity of the rock bolt. This is achieved by interaction between the restrainer member and each of the facing wall surface of the bore and the bar or cable. The load tending to eject the bar or cable is transferred to the restrainer member through the engagement between the restrainer member and the bar or cable, and the load is reacted by frictional engagement between the restrainer member and the bore surface, thus preventing ejection under loads that are below the maximum frictional load existing by the frictional engagement. There can also be frictional interaction between the restrainer member and the inside surface of the tube to increase the level of frictional engagement that resists movement of the bar or cable out of the tube.

The present invention also relates to a restrainer member for use in a friction rock bolt.

The portion of the bar or cable that could be ejected from the bore is that portion that is on the side of the failure of the bar or cable that is towards the open end of the bore and the portion could comprise anywhere from a small to a large portion of the bar or cable, depending on where the failure occurs.

The weakened region of the tube is a region of the tube close to or adjacent to the ring which is welded to the trailing end of the tube. The weakened region is often a portion of the tube that is either just outside of the bore into which the rest of the rock bolt is inserted, or it is a portion that extends a small way into the bore. In either case, the weakened region of the tube either has no frictional engagement with the surface of the bore or insignificant frictional engagement. When failure occurs at the weakened region, the portion of the tube inboard of the failure remains in place in the bore in frictional contact with the bore surface and it is through the longitudinal split of that section of the tube that the restrainer member can frictionally engage the bore surface for restraining ejection of the bar or cable. As indicated, the restrainer member can also be in frictional engagement with the inside surface of the same section of the tube to increase the frictional resistance to ejection of the bar or cable.

The weakened region is so called, as the action of welding the ring to the tube generally alters the strength of the tube adjacent the ring in a manner to weaken the strength of the tube in that region. That weakening occurs as a result of the heat generated during welding and the region is alternatively known as a "heat affected zone". Despite this, weakening in the weakened region or the heat affected zone might not always occur to the extent that the tube weakens sufficiently for it to fail in that region under sufficient load in preference to other parts, zones or regions of the tube. In addition, changes in welding techniques could be such that weakening in the weakened region or the heat affected zone is negligible or again, is at least not sufficient for the tube to fail in that region in preference to other parts, zones or regions of the tube. Regardless, it is generally understood in the industry that where the tube is most likely to be weakened upon welding of the ring is the heat affected zone or that region of the tube which is close to or adjacent to the ring.

The heat affected zone generally will occur within about 20 mm of the ring. The heat affected zone can usually occur within a region of up to 40 mm of the ring. This applies to rock bolts that employ tubes that have an outside diameter of between 33 mm and 47 mm and a wall thickness of between 2 mm and 4 mm.

Effectively the invention provides a frictional engagement inboard of the weakened region of the tube so that failure of the tube at that region combined with failure of the bar or cable, does not free the bar or cable for ejection from the bore. The frictional engagement can be at any suitable position inboard of the weakened region such as commencing adjacent the weakened region or being spaced away from the weakened region. The restrainer member maintains a connection or engagement with the facing bore surface inboard of the weakened region and the bar or cable so that ejection of the bar or cable is resisted and most preferably restrained. The restrainer member can also maintain a connection or engagement with the inside surface of the tube.

The projection of the restrainer member projects through the longitudinal split of the tube for engagement with the facing wall of the bore that the rock bolt is inserted into. The projection can include a profile that enhances frictional engagement with the bore wall and in some forms of the invention, the profile can include ribs or barbs or the like, that extend laterally across the projection for that purpose. A profile of other shape could alternatively be adopted and this could include a plurality of fingers or teeth or the like that project from the restrainer member, or from a face of the projection of the restrainer member, for engagement with the bore wall. The profile could be selected to bite into the bore wall, particularly upon movement of the restrainer member in an ejection direction upon failure of the tube and the bar or cable. For example, where barbs are provided, the barbs could be inclined so that movement of the restrainer member in an ejection direction causes the barbs to tend to grip or bite into the bore wall upon that movement. Alternatively, the wall engaging surface of the projection could be a flat or smooth surface, or could include longitudinal or lateral grooves. The profile of the wall engaging surface of the projection can provide accommodation for changes in the surface of bore wall, such as having flexibility to be squashed.

The profile of the projection might be such as to grip or bite into the bore wall prior to a failure of the tube and in some forms of the invention, that biting or gripping will occur on installation of the rock bolt into a bore. Small amounts of movement in the rock strata relative to the restrainer member after installation will also tend to settle the profiled surface of the projection into a position in the profile can grip or bite into the bore wall.

The use of a projection that projects through the longitudinal split formed in the tube for engagement with the wall of the bore provides a primary resistance to bar or cable ejection, while engagement between the restrainer member and the inside surface of the tube provides a secondary resistance. The level of resistance provided by each can be different, so that the primary resistance is not necessarily greater than the secondary resistance.

The restrainer member can extend past the weakened region any suitable amount to provide a suitable frictional engagement with the facing bore surface and optionally with the inside surface of the tube for the purpose of restraining the bar or cable from ejection from the bore upon both the bar or cable and tube failing. In testing completed to date, the total length of the restrainer member has been from about 50 mm to about 150 mm. A longer length of restrainer member is preferred over a shorter length. Suitable total lengths include from 50 mm to 300 mm but 150 mm is preferred. A longer length of restrainer member can be advantageous by improving the extent of frictional engagement with the facing bore surface, although as explained below, various factors can influence the length of the restrainer member.

The level of friction that is developed between the restrainer member and the facing bore surface past the weakened region needs to be sufficient to resist or restrain the bar from ejection under load from the rock strata and following failure of the tube and the bar or cable. That level of friction might vary depending on the expected loading of the rock bolt. The level of friction will also be dependent on the material of the restrainer member and its interaction with the facing bore surface and optionally with the inside surface of the tube. While the inside surface of the tube can be roughened to improve frictional engagement, the material of the restrainer member can also be selected for optimum frictional engagement. Suitable materials which have been successfully employed to date include high density polyethylene (HDPE) which has shown advantageous frictional qualities.

The restrainer member extends longitudinally within the tube past the weakened region in the direction of the leading end of the tube. This allows for one end of the restrainer member to extend on either side of the weakened region, or for the restrainer member to extend only on the side of the weakened region that is towards the leading end of the tube.

The restrainer member is disposed within the tube adjacent the ring. This allows the restrainer member to be spaced from but very close to the ring, or even in engagement with the ring. This also allows the restrainer member to be spaced from the ring such as up to about 650 mm from the ring.

Where there is engagement between the outside surface of the restrainer member and the facing inside surface of the tube, this can be full engagement or partial engagement. Full engagement advantageously maximises frictional contact between the inside surface of the tube and the outside surface of the restrainer member. Full engagement recognises that the tube has a longitudinal split, so that in full engagement, there is only engagement with the portions of the tube about the split.

There can alternatively be arrangements whereby the restrainer member does not have full engagement with the facing inside surface of the tube. For example, the restrainer member might have contact with a portion of the available inside surface of the tube and in a cylindrical tube the restrainer member might be in contact with 270° of the inside surface. To provide a longitudinal split, the available inside surface of the tube might be about 300° and the restrainer member might be in contact with that full surface area or a reduced area. The amount of contact with the inside surface of the tube can be dependent on the amount of frictional load required.

The level of friction that is developed between the restrainer member and the inside surface of the tube inboard of the weakened region can be increased by the tightness of the fit between the restrainer member and the tube. The restrainer member can include a central bore to receive the bar or cable. The outside diameter of the restrainer member can be close to or equal to the inside diameter of the tube for the portion of the tube the restrainer member is to engage. The outside diameter of the restrainer member can be greater than the inside diameter of the tube. This is advantageous where the bore that is drilled into the rock strata is of a smaller diameter than the outside diameter of the tube, so that the tube tends to be compressed as it is inserted into the bore. Thus, as the tube is compressed, the frictional engagement between the restrainer member and the inside surface of the tube increases.

The preference is that the outside diameter of the restrainer member that remains inside the tube is about equal to the inside diameter of the tube before the tube is inserted into the bore. This has the same advantage as described above in that the frictional engagement between the restrainer member and the inside surface of the tube increases as the tube is forced into the bore, but in addition, the restrainer member is more easily inserted into the tube prior to the tube being inserted into the bore.

The restrainer member could be formed tubular rather than as a cylinder, if an alternative shape provides enhanced frictional grip or the tube is other than cylindrical, such as hexagonal for example.

As described above, the bore that is drilled into the rock strata is intended to be of a smaller diameter than the outside diameter of the tube, so that the tube tends to be compressed as it is inserted into the bore. Given that the tube is split longitudinally, compression of the tube will result in a narrowing or reduction of the width of the split. In this arrangement, a restrainer member that is inserted into the tube before the tube is inserted into the bore can be forced into tight frictional engagement with the internal surface of the tube as insertion of the tube takes place.

The restrainer member can be installed in any suitable manner and for example, the restrainer member can be formed as described above as a single part comprising a cylinder with a central bore and the bar or cable can be inserted through the bore prior to insertion of the restrainer member and the bar or cable into the tube. Alternatively, the restrainer member could be inserted into the tube first and the bar or cable could be inserted through the bore second. Alternatively, the restrainer member can be formed as a single part comprising a cylinder with a central bore, but the part could be slotted or slitted longitudinally through the length of the wall of the part between the outside surface of the part and the central bore, so that the restrainer member can be opened longitudinally and placed around the bar or cable rather than requiring the bar or cable to be inserted through the bore.

In a further alternative, which can assist installation of the restrainer member into the tube of a rock bolt, the restrainer member can be formed in two separate parts. The parts can be symmetrical or asymmetrical. Thus one of the parts can include the projection or both of the parts can include part of the projection, so that the projection is fully formed when the two parts are assembled together. This provides advantages in assembly of a rock bolt according to the invention as follows. By this two-part arrangement, the first part of the restrainer member can easily be inserted into the tube as each of the bar or cable and the expansion mechanism are installed into the tube, but before the bar or cable has been positioned at its final installed position. Advantageously, in this intermediate position, there is ample room within the tube for the first part of the restrainer member to be easily inserted into the tube. The first part will include part of the central bore of the restrainer member and will be positioned on one side of the bar or cable.

The second part of the restrainer member can be inserted into the tube by applying the second part to the other side of the bar or cable, and as the bar or cable is pushed to the final installed position, the second part can be pushed in as well. Thus, the second part can be attached to the bar or cable or placed into position about the bar or cable and be pushed into the tube with the bar or cable. The dimensions of the restrainer member can be such that force will be needed to push the bar or cable into the tube with the second part of the restrainer member attached, as the second part will start to frictionally engage the inside surface of the tube as it enters the tube and it will frictionally engage the first part of the restrainer member as it approaches its final position within the tube. Suitable installation force can be provided with normal installation equipment, such as hammers, mallets, pneumatic or hydraulic rams, or other mechanical pushing devices. The standard construction of the trailing end of the rock bolt usually will include a washer against which the trailing end of the second part can engage. The washer is part of the anchor that is attached to the trailing end of the bar or cable so that force can be applied to the anchor to insert the bar or cable into the tube and inward movement of the anchor and the bar or cable results in inward movement of the second part of the restrainer member.

Once both of the first and second parts are installed, the first and second parts will be in contact and the restrainer member can be in firm frictional contact with the inside surface of the tube. The projection will project through the longitudinal split in the tube for engagement with the bore surface. The restrainer member will thereafter act in the manner required to restrain ejection of the bar or cable from the bore in the event of bar or cable and tube failure.

In some forms of the invention, the first and second parts engage when installed in a tube along inclined or angled faces on either side of the bar or cable. Advantageously, the first and second parts effectively wedge together as the parts move towards each other, ensuring secure connection between the two parts. This assists installation as the force required for the initial stage of the installation is low (because the wedging between the first and second parts does not take place until the parts are at the almost fully installed positions) and increases as the first and second parts engage and start to wedge. Moreover, where one of the parts includes the projection, that part can be inserted into the tube first. This is advantageous because the ring which is welded to the trailing end of the tube presents a barrier to such a projection if the restrainer member is not formed in two parts as the projection will project beyond the inside diameter of the ring and will otherwise need to be deformed to push past the ring.

The inclined or angled faces of the first and second parts of the restrainer member can be smooth faces or rough faces as required to maintain them from separation during operation of the rock bolt. The friction load between the first and second parts can be sufficient to locate them together, or a suitable locating arrangement can be employed. For example, the first and second parts can be glued together. Alternatively, one or both of the first and second parts can include a lip or finger at their trailing ends that is positioned on the opposite side of the ring of the rock bolt to the remainder of the restrainer member when the restrainer member is fully installed. Alternatively, the ring can seat within an annular groove or channel in the trailing end of the restrainer member to locate the restrainer member. The restrainer member can interact with other parts of the rock bolt as appropriate to locate the restrainer member. The above arrangements can also apply to first and second parts that do not engage along angled faces as well as to first and second parts that do not include a projection of the kind discussed below.

In a further alternative, the restrainer member can be formed in two parts in which the first part is a body and the second part is or includes the projection. The body can comprise a major part of the restrainer member or it can comprise substantially all of the restrainer member other than the projection. Where the body comprises substantially all of the restrainer member other than the projection, the body can be a tube or cylinder that extends about and engages the bar or cable, and which optionally can also engage the inside surface of the tube. The body and the projection can include cooperating connectors to connect them together. In one form, the body can include an opening or openings to accept a pin or pins or the like formed to extend from the underside of the projection. The pins can be formed to provide a snap connection with the body. The pins could alternatively be separate threaded bolts that pass through the projection and into threaded connection with threaded openings in the body. The heads of the bolts could be seated in recesses in the projection so as not to interfere with the portion of the projection that is intended to engage the wall surface of a bore.

Other arrangements to connect the projection to the body could be employed. For example, the outer surface of the body could include a recess to accommodate a bottom or base portion of the projection, or the bottom or base portion of the projection could include one or more projections that extend into one or more recesses or openings in the body. Glue or adhesive could be used. The arrangement which is to be adopted is an arrangement that secures the projection relative to the body but which allows the projection to be separate from the body until complete installation of the restrainer member is required. Other arrangements of this general kind could be formed and are within the scope of the present invention.

Where the body comprises a major part of the restrainer member other than the projection, the body can be a part tube or cylinder that extends partially about the bar or cable and engages the bar or cable. The body can optionally also engage the inside surface of the tube. The body might be a cylinder for example that includes a longitudinal split or slot into which a base of a projection extends in an assembly of this form of the restrainer member. The split or slot might be wedge shaped and the base of the projection could have a complementary shape for wedging connection between the body and the projection. Other arrangements of this general kind could be formed and are within the scope of the present invention.

The above arrangement allows the projection to be formed from a different material than the body. This might be useful where respective frictional engagement with the internal surface of the tube and the surface of the bore wall is enhanced by different materials of the restrainer member.

Installation of the above forms of restrainer member can be by connecting the first part to the bar or cable in abutment with a suitable abutment that is formed on the bar or cable. A ferrule could be swaged onto the bar or cable either before the first part is fitted or afterwards. The ferrule can be a piece of tube which is fitted to the bar or cable and then swaged onto the bar or cable. A washer can be positioned to be interposed between the ferrule and the first part. The bar or cable, with all fixtures except the second part (the projection) assembled to it can then be inserted into the tube whereafter the second part can be fitted to the first part and installation of the restrainer member is then complete.

It is an option to form the first part of the above arrangement in two parts, like the earlier example in which the restrainer member is formed of two parts, but in this later form of the invention, the projection remains a separate part for later connection to the first part, regardless as to whether the first part is itself formed of two or more parts.

As an alternative to or in addition to frictional engagement between the restrainer member and the inside surface of the tube, the tube can interact with the restrainer member in order to resist relative movement between the restrainer member and the portion of the tube inboard of the weakened region, upon failure of the tube at the weakened region. In some forms of the invention, the tube can be deformed inwardly after the restrainer member has been inserted into the tube to form an indent that pushes into the side wall of the restrainer member. For this, the restrainer member must be formed from a material that is flexible or malleable and in some forms of the invention, these characteristics are provided in a restrainer member that is formed from HDPE. Other plastic materials could equally be employed. In this form of the invention, the side wall deformation also assists to maintain the first and second parts from separation during operation of the rock bolt.

In other forms of the invention, the facing surfaces of the restrainer member and the tube can be glued together for the purpose of resisting relative movement between the restrainer member and the inboard portion of the tube upon failure of the tube. Gluing can be combined with deformation of the kind referred to above.

It is to be noted that the restrainer member is to be manufactured of a material that is not expected itself to fail under load. Thus, while the bar or cable and the tube can fail, the restrainer member will retain its structure and integrity and will maintain frictional engagement with the bore wall and optionally with the inside surface of the tube during failure. The plastic materials referred to above from which the restrainer member could be made are expected to ensure that the restrainer member will not itself fail under conditions in which the bar or cable and the tube fail.

The provision of a projection that engages the facing bore wall surface also applies a compressive force to the restrainer member itself upon installation of the rock bolt into the bore that advantageously acts to maintain the first and second parts of a two part restrainer member together. The restrainer member extends about the bar or cable in engagement with the bar or cable. One form of engagement has been given above by swaging a ferrule to the bar or cable against which one end of the restrainer member engages or abuts. The engagement with the bar or cable is necessarily sufficient to prevent ejection of the bar or cable from the bore in the event of failure of the tube and the bar or cable. The engagement between the restrainer member and the bar or cable can take any suitable form. In some forms of the invention where the rock bolt includes a bar rather than a cable, the bar would often include surface ribs or threads along the length of the bar. These are not necessarily required for operation of the rock bolt, but are provided as a normal component of the type of bar that is used for rock bolt construction. Where this type of bar is employed, the ribs or threads can be removed in the section of the bar about which the restrainer member is installed, to ensure that a tight fit is made between the bar and the restrainer member. However, the fit between the bar and the restrainer member is not required to be so tight as to prevent or significantly restrict movement of the bar for actuating the expander mechanism. The expander mechanism is usually actuated by either rotating the bar or pulling on the bar axially and the fit between the bar and the restrainer member cannot be such as to prevent that movement.

Removal of the ribs or threads from the section of the bar about which the restrainer member is installed also allows the remaining ribs to form an abutment against which the leading end of the restrainer member can abut in the installed condition of the rock bolt. Advantageously, this is a simple manner by which an abutment can be formed. By that abutment, the bar cannot be ejected while the restrainer member remains firmly secured within the tube. The tightness of the fit between the inside surface of the tube and the facing surface of the restrainer member, and between the bore of the restrainer member and the bar, is preferably sufficient that the abutting threads will not push into the bore of the restrainer member during operation of the rock bolt.

It will be appreciated that any form of abutment could be employed and they could be formed integrally with the bar or as an addition to the bar. Abutments could also be applied to cables used in rock bolts. Removal of the ribs or threads from the section of the bar about which the restrainer member is installed is one way of forming an abutment, while other alternatives include forming protrusions in the bar, such as by crimping the bar, or by swaging a ferrule onto the bar or cable as discussed above.

BRIEF DESCRIPTION OF DRAWINGS

In order that the invention may be more fully understood, some embodiments will now be described with reference to the figures in which:

FIG. 8 is a cross-sectional view of the arrangement of FIG. 7.

FIGS. 9 and 10 are perspective views of the separate parts of the restraining member of FIG. 3.

FIG. 11 is a perspective and exploded view of a restrainer member according to another embodiment of the invention.

FIG. 12 is a cross-sectional view of the restrainer member of FIG. 11 installed in a rock bolt.

FIG. 13 shows a section of bar with a ferrule attached by swaging.

DETAILED DESCRIPTION

Figure 1:
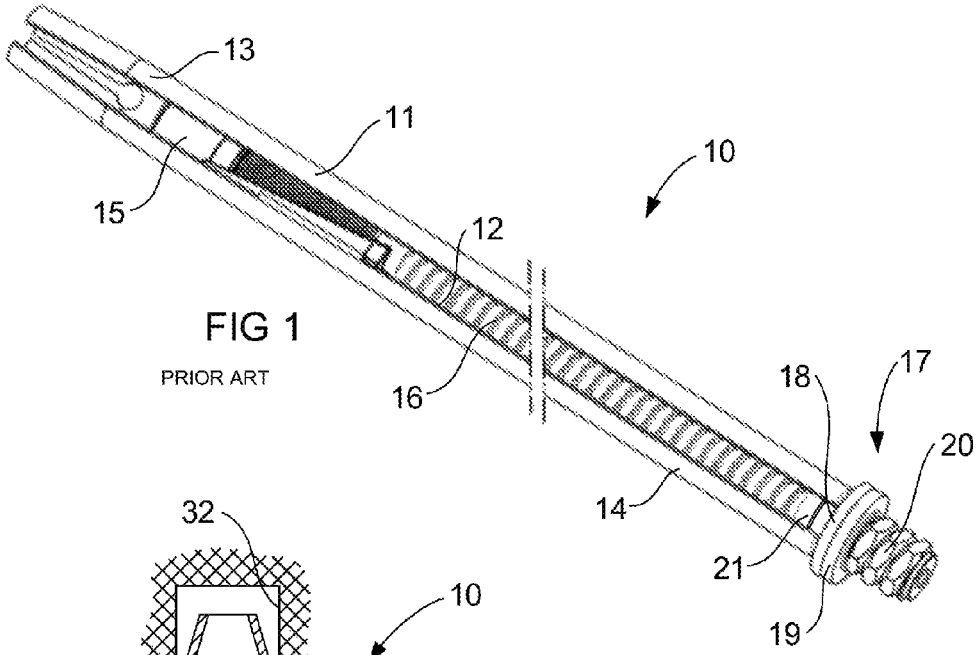
FIG 1 PRIOR ART
FIG. 1 is a perspective view of a prior art rock bolt.

FIG. 1 is a perspective view of an example rock bolt for use with a restrainer member according to the invention. The rock bolt 10 includes an elongate, generally circular tube 11, which includes a longitudinal split 12 which enables the tube 11 to be radially expanded. The tube 11 has a leading end 13 and a trailing end 14. An expander mechanism 15 is disposed within the tube 11 in the region of the leading end 13 and is operable to apply a load which tends to expand at least the leading end 13 of the tube 11 radially. The expander mechanism 15 can take any suitable form, and includes wedge arrangements that include at least a pair of wedge elements that expand as they move relative to one another.

The rock bolt 10 further includes a bar 16 that is disposed longitudinally within the tube 11 and which is connected at one end with the expander mechanism 15 and at the other end with an anchor arrangement generally designated by the reference numeral 17. In some forms of rock bolts, the end of the bar 16 that is connected to the anchor arrangement 17 is connected by a wedge arrangement.

The anchor arrangement includes a ring 18 that is welded to the trailing end 14 of the tube 11, a washer 19, a nut 20 that is threaded onto the trailing end of the bar 16 and a centering plug 21. The nut 20 is a blind nut that threads onto the end of the bar 16, but once the nut 20 is fully rotated onto the end of the bar, the nut will not rotate further relative to the bar 16. Accordingly, further rotation of the nut 20 causes the bar 16 to rotate. The nut 20 can glued to the end of the bar 16 for further attachment security.

In the rock bolt 10 which is illustrated, rotation of the nut 20 in one direction rotates the bar 16 in a direction that causes the expander mechanism 15 to expand. Alternative forms of rock bolt can include a cable rather than a rigid bar 16 and in those arrangements, expansion of the expander mechanism 15 is by applying a pull force to the cable.

Not shown in FIG. 1, is a rock plate, that would normally rest against the side of the ring 18 that faces the rock strata and which bears against the face of the rock strata into which the rock bolt 10 has been installed. The rock plate spreads load which is applied to the rock plate by the rock bolt across the rock face immediately adjacent the opening of the bore into which the rock bolt 10 is installed.

Figure 2:
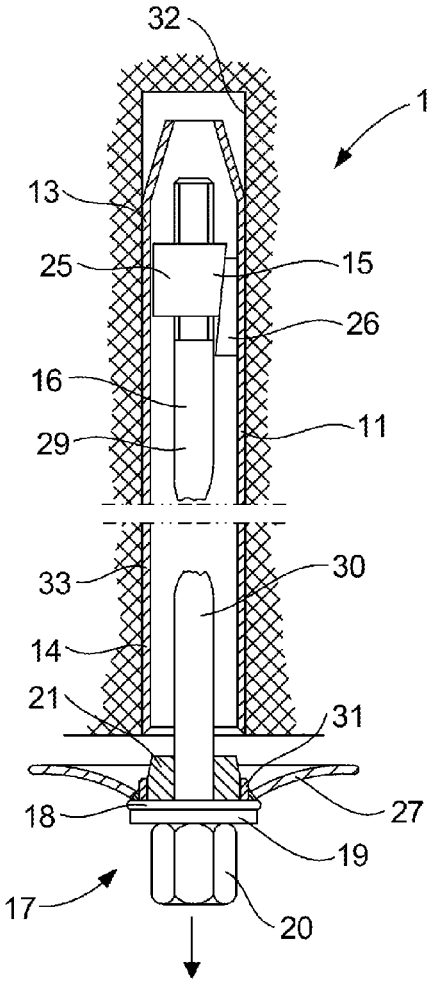
FIG 2 PRIOR ART
FIG. 2 is a cross-sectional view of the rock bolt of FIG. 1.

A cross-sectional view of the rock bolt 10 is illustrated in FIG. 2 and this also illustrates a problem which has been encountered in relation to the use of such rock bolts. In FIG. 2, an expansion mechanism is illustrated comprising a pair of wedge elements 25 and 26. The wedge element 25 is threadably connected to the bar 16 while the wedge element 26 is fixed to the inside surface of the tube 11, such as by welding. It will be appreciated that movement of the wedge element 25 relative to the wedge element 26 downwardly in the orientation of the rock bolt 10 of FIG. 2 will result in expansion of the expander mechanism 15 to cause radial expansion of the tube 11 at least in the region of the expander mechanism 15. Movement of the wedge element 25 relative to the wedge element 26 downwardly is by rotation of the bar 16 by rotating the nut 20. The interaction between the wedge elements 25 and 26 prevents the element 25 from rotating with the bar 16.

FIG. 2 also illustrates a rock plate 27, that rests against the inside surface of the ring 18. The weld shown in FIG. 2 is between the ring 18 and the tube 11. Other features which have already been described in relation to FIG. 1 and which appear in FIG. 2 retain the same reference numerals.

The cross-sectional view of the rock bolt 10 of FIG. 2 is modified from that shown in FIG. 1 to show failure of the rock bolt 10 at three positions. Firstly, the tube 11 has failed adjacent the ring 18. Secondly, the bar 16 has failed and now comprises separated leading and trailing parts 29 and 30. Thirdly, the tube 11 has failed adjacent the free end of the bar part 29. Failure of that kind often occurs when the bar 16 fails. Because of the first and second failures, the portion of the rock bolt 10 that comprises the trailing part 30 of the bar 16, the anchor mechanism 17, a small portion 31 of the tube 11 and the rock plate 27 can all be ejected under load from the bore 32 within which the rock bolt 10 is inserted.

It is to be noted that despite the failure of the tube 11 at two positions, the portion 33 of the tube 11 between the failures remains in place within the bore 32 and is not ejected, because the portion 33 of the tube 11 remains in frictional contact with the internal surface of bore 32.

The failure of the bar 16 can take place at any point along the length of the bar 16. However, failure of the tube 11 has been found to take place in a region of the tube which has been weakened through the action of welding the ring 18 to the tube. That action generally alters the strength of the tube 11 adjacent the ring 18 in a manner to weaken the strength of the tube in that region. That weakening occurs as a result of the heat generated during welding and the region is also known as a "heat affected zone". The heat affected zone generally will occur within about 20 mm of the ring 18.

Figure 3:
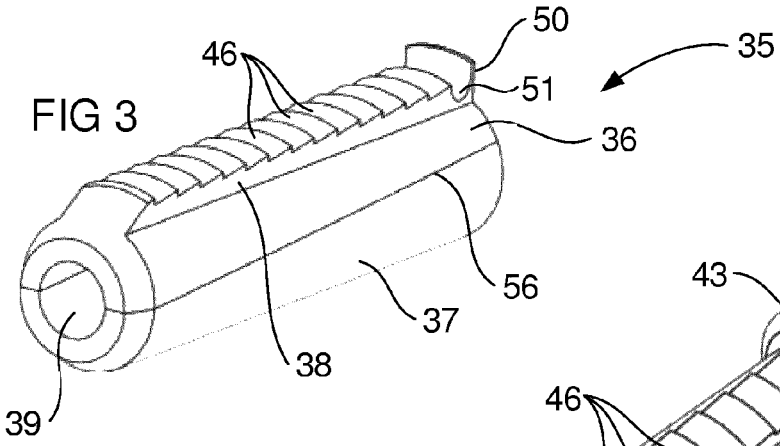
FIG. 3 is a perspective view of a restrainer member according to one embodiment of the invention.

The invention resides in a rock bolt that employs a restrainer member and one form of that member is illustrated in FIG. 3. The restrainer member 35 is formed in two parts 36 and 37 and includes an integral projection 38 that projects from the part 36. Apart from the projection 38, the restrainer member 35 is part cylindrical as shown, but it could be non-cylindrical tubular in other forms of the invention. The restrainer member 35 is cylindrical (apart from the projection) to suit the inside diameter of the tube 11 into which the restrainer member 35 is to be inserted.

The restrainer member 35 further includes a central bore 39 which is of substantially the same diameter as the outside diameter of the bar of the rock bolt to which the invention applies. Again, the shape of the bore could be different to that shown in FIG. 3 to suit a non-circular bar, such as a square or hexagonal bar.

Figure 4:
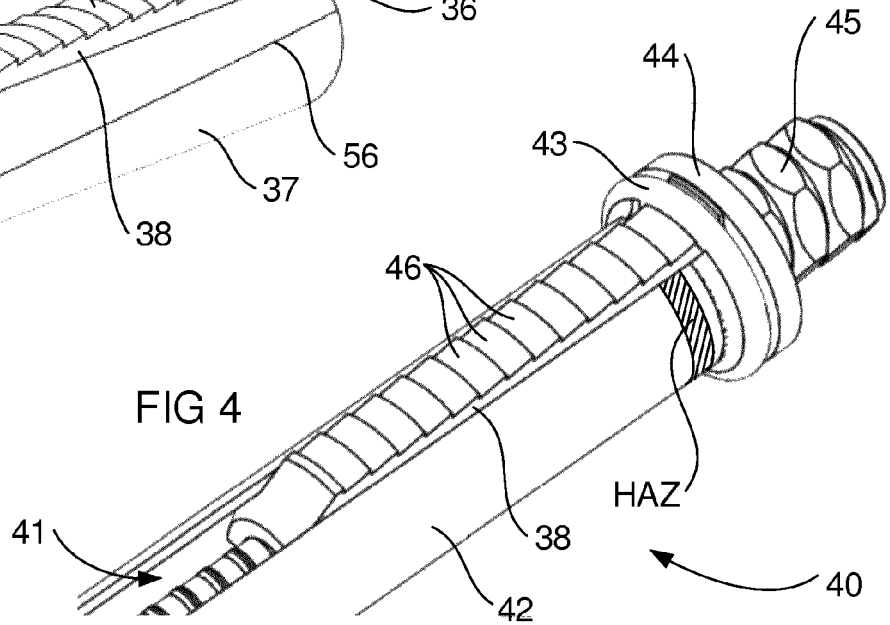
FIG. 4 is a perspective view of the restrainer member of FIG. 3 installed in the trailing end of a rock bolt.

FIG. 4 illustrates the trailing end of a rock bolt 40 according to the invention in perspective view and shows the projection 38 extending through the longitudinal split 41 of the tube 42. The rock bolt 40 includes a ring 43, a washer 44 and a nut 45 which have the same operation as the same features of the rock bolt 10.

Figure 5:
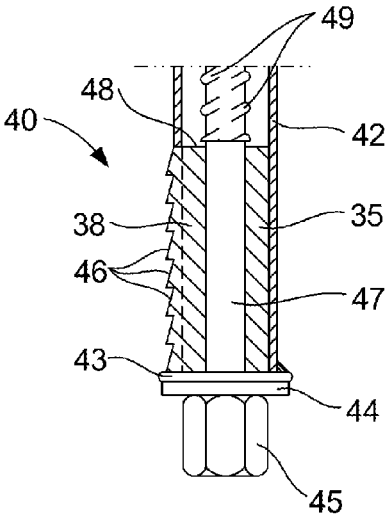
FIG. 5 is a cross-sectional view of the FIG. 4 arrangement.

FIG. 5 shows the FIG. 4 arrangement in cross-section and that figure also shows the close fit of the restrainer member 35 about the bar 47. The fit about the bar 47 is close but does not prevent the bar 47 from being rotated as required for moving the wedge element 25 of the rock bolt 10 relative to the wedge element 26 to expand the expander mechanism 15. The restrainer member 35 could be a loose fit about the bar 47 or a tight fit as shown. A tight fit is preferred. FIG. 5 also shows the outer surface of the restrainer member 35 in engagement with the facing and inside surface of the tube 42. That engagement is optional, but if provided is preferably of significant frictional engagement.

When comparing the rock bolts of FIGS. 2 and 5, it can be seen that the restrainer member 35 extends well past the point at which the tube 11 has failed at reference numeral 31. In the illustrated embodiment, the restrainer member extends on either side of the weakened region, but in alternative embodiments, the restrainer member could extend only on the side of the weakened region that is towards the leading end 13 of the tube. The restrainer member could be spaced from the ring 18 or 43 such as up to about 650 mm from the ring.

Also, the restrainer member 35 extends in frictional engagement with the inside surface of the tube 42 for the full or at least the majority of its length. The restrainer member 35 thus frictionally engages the inside surface of the tube 42 inboard of and well past the weakened region or the heat affected zone (marked HAZ in FIG. 4) of the tube.

The illustrated form of the restrainer member 35 also includes the projection 38 for restraint against ejection of the trailing end of the rock bolt 40 from the bore. The projection 38 is formed to frictionally engage the inside surface of the bore into which the rock bolt 40 is inserted. The projection 38 has a profile that includes a plurality of barbs 46 that enhance frictional engagement with the bore wall (wall 32 in FIG. 2). The barbs 46 extend laterally across the projection 38 and are inclined so that movement of the restrainer member in an ejection direction causes the barbs 46 to tend to grip or bite into the bore wall upon that movement.

FIG. 5 also shows ribs 49 formed on the outer surface of the bar 47 over a section of the bar 47 inboard of the restrainer member 35. The ribs 49 have been removed from the section of the bar about which the restrainer member is installed and this allows the ribs 49 to form an abutment against which the leading end 48 of the restrainer member 35 can abut in the installed condition of the rock bolt. By that abutment, ejection of the bar 47 is restrained while the restrainer member 35 remains firmly secured in frictional engagement with the inside surface of the tube 42 and with the wall surface 32 of the bore in which the rock bolt 40 is installed. The tightness of the fit between the inside surface of the tube 42 and the facing surface of the restrainer member 35, and between the bore 39 of the restrainer member 35 and the bar 47, is preferably sufficient that the ribs 49 will not push into the bore 39 during operation of the rock bolt 40. As described earlier, other forms of abutment can be employed.

Thus, in the illustrated arrangement, failure at the HAZ zone combined with failure of the bar 16 does not free the trailing end of the tube 42 and the components and accessories at that end for ejection from the bore. Rather, the restrainer member 35 maintains frictional connection between the inside surface of the tube 42 inboard of the HAZ and the bar 16, as well as with the wall surface 32 so that ejection of the bar part 30 and the associated components and accessories is resisted and most preferably restrained.

Figure 6:
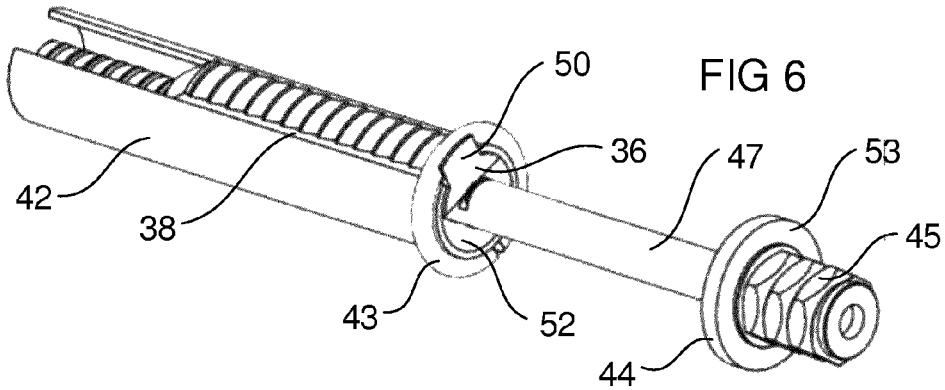
FIG. 6 shows the trailing end of a rock bolt with one part of a restrainer member according to the invention installed.
Figure 7:
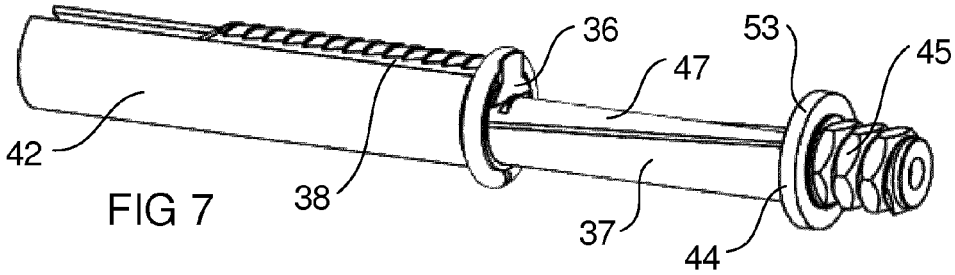
FIG. 7 shows the arrangement of FIG. 6 with a second part of the restraining member positioned for installation.

The two part arrangement of the restrainer member 35 is preferred for ease of installation. With reference to FIGS. 6 and 7, the first part 36 is installed into the tube 42 about the bar 47 when the bar 47 is not inserted fully into the tube 42. The part 36 is more easily installed first into the tube 42 because it is otherwise difficult to insert the projection 38 past the ring 43 if the restrainer member 35 is formed in one piece. Clearly if the restrainer member 35 is formed completely as a cylinder, the difficulty with insertion of the member is not as difficult. However, when a projection is included, the two part construction is preferred.

With the first part 36 is installed into the tube 42 as shown in FIG. 6, the second part 37 can be installed and thereafter, the bar 47 can be pushed into the tube 42 to assume the position shown in FIG. 4. In FIG. 7, the part 37 is shown positioned for insertion with the leading end positioned at the opening 52 of the tube 42 and the trailing end in abutting engagement with the flange 53. The part 37 is pushed into the tube 42 as the bar 47 is pushed in.

The part 36 is prevented from movement from the installed position of FIG. 6 by the provision of a lip or finger 50 that is positioned on the trailing side of the ring 43. FIG. 8 shows the FIG. 6 arrangement in cross-section and shows that the ring 43 seats in a groove 51 adjacent the finger 50.

Also, the second part 37 does not engage the first part 36 until close to full insertion of the part 37 into the tube 42 because of the inclined engaging surface between them. FIGS. 9 and 10 illustrate the first and second parts 36 and 37 separately and show respective inclined engagement surfaces 54 and 55 that form an inclined engagement line 56 (see FIG. 3) in the engaged form of the first and second parts 36 and 37. Engagement surfaces 54 and 55 are shown to be smooth in the figures, but in other forms of the invention, those surfaces can be roughened to promote more secure engagement between the parts 36 and 37. Alternatively, one of the surfaces 54 or 55 could include dimples, and the other projections, so that the dimples and projections mate in the connected form of the part 36 and 37. Still further, the surfaces 54 and 55 could be stepped or otherwise shaped for engagement purposes.

An alternative arrangement of the invention in which the restrainer member is formed in two parts is illustrated in FIG. 11. In that figure, the restrainer member 60 comprises a first part which, in FIG. 11 is formed as a cylinder 61, which is a complete cylinder and which includes a central and circular bore 62. The cylinder 61 includes a pair of spaced apart openings 63 into which snap connectors 64, which extend from an underside 65 of a projection 66, can enter and be captured. The projection 66 includes a series of barbs 67 of the kind shown in the earlier figures as barbs 46. The barbs 67 operate in the same manner as the barbs 46 to engage the wall surface of a bore wall.

FIG. 12 shows a cross-sectional view of the trailing end of a rock bolt to which the restrainer member 60 has been fitted. The FIG. 12 illustration is shown outside of a bore for the purposes of clarity.

FIG. 12 shows a tube 70 that includes a longitudinal split like the earlier tubes 11 and 42 through which the projection extends. A bar 71 is disposed longitudinally within the tube 70 and extends to an anchor arrangement which includes a nut 72. The bar 71 extends through a washer 73 and a ring 74 which is welded to the outside surface of the tube 70. Each of the nut 72, the washer 73 and the ring 74 operate in accordance with the equivalent features of the earlier embodiments.

The cylinder 61 of the restrainer member 60 is disposed about the trailing portion of the bar 71. Different to the arrangement of FIG. 5, the ribs 75 of the bar 71 have not been removed in the region of the restrainer member 60, but rather, the ribs 75 continue along the bar 71 to the end of the bar and abutment between the restrainer member 60 and the bar 71 is provided by a swaged ferrule 76 which is swaged onto the bar 71. FIG. 13 illustrates the portion of the bar 71 to which the ferrule 76 is swaged. The ferrule 76 can be for example, a length of tube (30 mm for example) which is swaged as shown into position of the bar 71.

Interposed between the ferrule 76 and the facing end 77 of the cylinder 61 is a washer 78. The opposite end 79 of the cylinder 61 is shown in engagement with the washer 73.

FIG. 12 shows the projection 66 fitted in connection with the cylinder 61. It can be seen from FIGS. 11 and 12 that the snap connectors 64 have a neck portion 80 and a head portion 81 which is split centrally. The connectors 64 are also resilient so that opposite sides of the neck and head portions can shift inwardly towards each other as the connectors 64 enter the openings 63 through the sections of smaller diameter $D_1$, and then can splay, flare or shift outwardly so that the head portions 81 shift into the larger diameter portion $D_2$ of the openings 63. This captures the head portions 81 in the larger diameter portion $D_2$ and secures the projection 66 to the cylinder 61.

The arrangements shown in FIGS. 11 to 13 provide an alternative arrangement for fitting the restrainer member 60 in place. The arrangement of those figures allows the cylinder 61 to be fitted to the bar 71, either before or after the ferrule 76 is swaged onto the bar 71 and once fitted, the bar 71 and associated components can be inserted fully into the tube 70. If the outside diameter of the cylinder 61 is slightly less than the inside diameter of the tube 70, then there will be no resistance to insertion of the bar and its associated components. The alternative is for the outside diameter of the cylinder 61 to be a light frictional fit, or even an interference fit with the inside diameter of the tube 70 and in those cases, the cylinder 61 will need to be forced into the tube 70.

Once the bar 71 has been positioned in the tube 70, the projection 66 can be fitted to the cylinder 61 by insertion of the snap connectors 64 into the openings 63. Once the connectors 64 splay or flare outwardly so that the head portions 81 move into the large diameter $D_2$ of the openings 63, the projection 66 is firmly connected to the cylinder 61.

The assembly of FIG. 12 can then be inserted into a bore drilled into a rocket strata and when the outer barbed surface 67 of the projection 66 engages the facing bore wall, it will tend to push the cylinder 61 towards the opposite inner surface of the tube 70 and increase the frictional engagement between the cylinder 61 and the tube 70. There will therefore be frictional resistance between the barb surface 67 of the projection 66 and the facing surface of the bore wall, along with frictional engagement between the cylinder 61 and inside surface of the tube 70. All that resistance will tend to resist ejection of a portion of the bar 71 and the nut 72, washer 73 and ring 74 on failure of both the bar 71 and the tube 70.

Following on from discussion in relation to the two-part construction of the restrainer member 35, it will be readily understood that the cylinder 61 could also be formed into parts, which either form a complete cylinder 61 or a part cylinder.

Moreover, it will be readily appreciated that the snap connectors 64 are just one method by which the projection 66 could be connected to the cylinder 61, and that other arrangements such as discussed earlier herein could be adopted.

The invention described herein is susceptible to variations, modifications and/or additions other than those specifically described and it is to be understood that the invention includes all such variations, modifications and/or additions which fall within the spirit and scope of the present disclosure.

The invention claimed is:

1. A friction bolt, for frictionally engaging the internal surface of a bore drilled into a rock strata, the friction bolt comprising:

an elongate, generally circular tube having a longitudinal split for radial expansion of the tube, the tube having a leading end and a trailing end;

an expander mechanism disposed within the tube in a region of the leading end for applying a load to expand at least one section of the tube radially;

an elongate bar or cable having opposed end disposed longitudinally within the tube, a first end of the bar or cable being connected with the expander mechanism and a second end of the bar or cable being connected to an anchor arrangement positioned at the trailing end of the tube;

a ring welded to the trailing end of the tube, the bar or cable extending through the ring beyond the trailing end of the tube into connection with the anchor arrangement; and a restrainer member disposed within the tube adjacent the ring, the restrainer member extending at least partly about the bar or cable and being in engagement with the bar or cable, the tube having a weakened region adjacent the ring and the restrainer member extending longitudinally within the tube past the weakened region in the direction of the leading end of the tube, the restrainer member including a projection that projects through the longitudinal split of the tube for engagement with a facing wall of a bore that the rock bolt is inserted into.

2. The friction bolt according to claim 1, wherein the projection extends longitudinally of the longitudinal split.

3. The friction bolt according to claim 1, wherein the projection has a profile that includes ribs or barbs extending laterally across the projection.

4. The friction bolt according claim 1, wherein the restrainer member extends past the weakened region by an amount of between 40 and 300 mm.

5. The friction bolt according to claim 1, wherein a length of the restrainer member is from about 50 mm to about 300 mm.

6. The friction bolt according to claim 5, wherein a length of the restrainer member is about 150 mm.

7. The friction bolt according to claim 1, wherein the restrainer member is tubular and has a central bore to receive the bar or cable.

8. The friction bolt according to claim 7, wherein the restrainer member is cylindrical.

9. The friction bolt according to claim 7, wherein the restrainer member has a diameter that is close to or equal to an inside diameter of the tube, prior to the tube being inserted into the bore.

10. The friction bolt according to claim 1, wherein the restrainer member is in engagement with an inside surface of the tube past the weakened region to create sufficient drag between the restrainer member and the inside surface of the tube past the weakened region, which upon failure of the tube in the weakened region and failure of the bar or cable form a leading bar or cable part and a trailing bar or cable part, the restrainer member restraining the trailing bar or cable part against ejection from the rock bolt.

11. The friction bolt according to claim 1, wherein the restrainer member is tubular and includes a central bore to receive the bar or cable and a slot or slit extending longitudinally through a length of the restrainer member between the outside surface of the part and the central bore.

12. The friction bolt according to claim 1, wherein the restrainer member is formed in two separate parts.

13. The friction bolt according to claim 12, wherein the two parts form an engagement when installed in the tube, the engagement occurring along inclined or angled faces of the two parts on either side of the bar or cable.

14. The friction bolt according to claim 13, wherein the engagement forms a wedge engagement.

15. The friction bolt according to claim 12, wherein one or both of the first and second parts include a lip or finger at a trailing end thereof that is positioned on a side of the ring of the rock bolt opposite the remainder of the restrainer member when the restrainer member is fully installed.

16. The friction bolt according to claim 12, wherein one or both of the first and second parts include an annular groove or channel at a trailing end thereof within which the ring of the rock bolt can seat.

17. The friction bolt according to claim 1, wherein the tube is deformed inwardly to form an indent that pushes into a side wall of the restrainer member.

18. The friction bolt according to claim 1, wherein the bar includes surface ribs or threads along a length of the bar which are removed in the section of the bar about which the restrainer member is installed.

19. The friction bolt according to claim 18, wherein the ribs or threads of the bar that are adjacent the leading end of the restrainer member form an abutment against which the leading end of the restrainer member abuts.

20. The friction bolt according to claim 1, wherein the restrainer member is formed in two parts, a first part being a body and a second part the projection.

21. The friction bolt according to claim 20, wherein the body and the projection include cooperating connectors that connect together.

22. The friction bolt according to claim 21, wherein the body includes an opening or openings to accept a pin or pins or the like formed to extend from an underside of the projection.

23. The friction bolt according to claim 22, wherein the pins are formed to provide a snap connection with the body.

24. A restrainer member for use with a friction bolt that is used for frictionally engaging an internal surface of a bore drilled into a rock strata, the friction bolt comprising;

an elongate, generally circular tube including a longitudinal split for radial expansion, the tube having a leading end and a trailing end;

an expander mechanism disposed within the tube in a region of the leading end for applying a load to expand at least a section of the tube radially;

an elongate bar or cable having opposed ends disposed longitudinally within the tube, a first end of the bar or cable being connected with the expander mechanism and a second and opposite end of the bar or cable being connected with an anchor arrangement positioned at the trailing end of the tube;

a ring welded to the trailing end of the tube, the bar or cable extending through the ring beyond the trailing end of the tube into connection with the anchor arrangement, the tube having a weakened region adjacent the ring, the restrainer member being arranged for insertion into the tube adjacent the ring, to extend longitudinally within the tube past the weakened region in the direction of the leading end of the tube and to extend about the bar or cable and to be in engagement with the bar or cable; and a projection projecting through the longitudinal split of the tube for engagement with a facing wall of the bore that the friction bolt is inserted into.

* * * * *